United States Patent [19]

Sudo

[11] 3,977,125

[45] Aug. 31, 1976

[54] DEVICE FOR SEALING STEEL DOORS OF COKE OVEN

[75] Inventor: Osamu Sudo, Fujisawa, Japan

[73] Assignee: Nippon Oil Seal Industry Co., Ltd., Japan

[22] Filed: Aug. 2, 1974

[21] Appl. No.: 494,364

[52] U.S. Cl. ..... 49/480; 49/494; 49/498; 202/248

[51] Int. Cl.[2] ..... E06B 7/22; C10B 25/06

[58] Field of Search ..... 49/493, 494, 498, 480, 49/485, 481, 475; 202/242, 248; 277/164, 150, 149

[56] References Cited

UNITED STATES PATENTS

| | | | |
|---|---|---|---|
| 992,793 | 5/1911 | Miner | 49/480 |
| 1,873,076 | 8/1932 | Ackeren | 202/248 |
| 1,980,720 | 11/1934 | Field et al. | 49/475 X |
| 2,130,017 | 9/1938 | Lewis | 49/493 X |
| 2,662,053 | 12/1953 | Brown | 202/248 X |
| 2,778,785 | 1/1957 | Otto | 202/248 |
| 2,825,940 | 3/1958 | Kurtz | 49/480 X |
| 2,923,984 | 2/1960 | Jecmen | 49/494 |
| 3,382,619 | 5/1968 | Bemis | 49/493 |

*Primary Examiner*—Philip C. Kannan
*Attorney, Agent, or Firm*—Holman & Stern

[57] ABSTRACT

A device for sealing a steel door of a coke oven includes a ring-shaped steel packing fitted over an outer surface of the steel door so as to contact a side wall of the coke oven when the steel door is closed, a packing retainer fitted over the outer surface of the steel packing and provided with a ring-shaped groove opened toward the side wall, a ring-shaped packing assembly fitted into the groove so as to press against the side wall and a holder for movably holding the steel packing and the packing retainer. The packing assembly extends closer to the side wall of the coke oven than the steel packing.

5 Claims, 12 Drawing Figures

FIG. 1
PRIOR ART
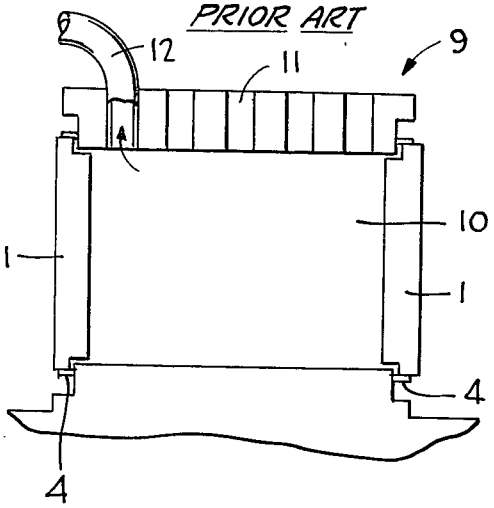
FIG. 2
PRIOR ART
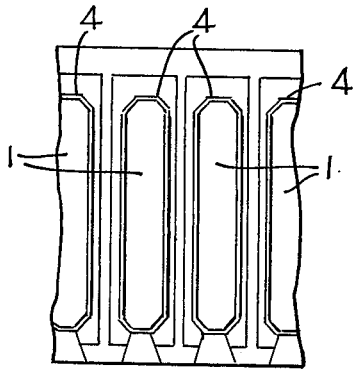
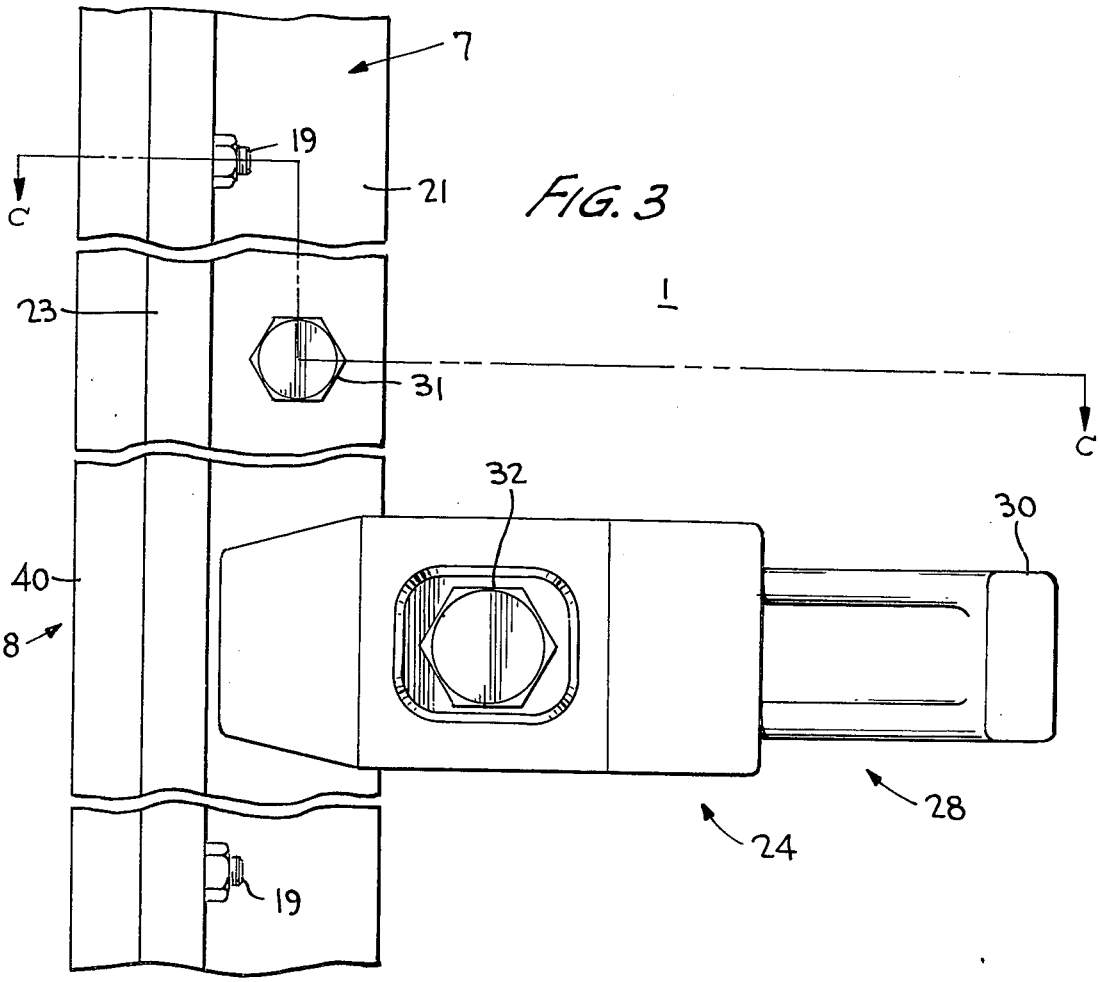
FIG. 3

DEVICE FOR SEALING STEEL DOORS OF COKE OVEN

BACKGROUND OF THE INVENTION

The present invention relates to a device for sealing doors of a coke oven.

One of the problems encountered in the operation of a coke oven is the leakage of gases and dusts from the coke oven because of insufficient sealing between steel doors and the side walls of the oven.

The above problem is discussed below with reference to a conventional coke oven as shown in FIGS. 1 and 2 of the drawings.

Referring to FIGS. 1 and 2, a plurality of steel doors 1 are installed on both sides of a coke oven 9. Coal is charged through a plurality of charging holes 11 formed through the top of the coke oven 9 into a coke oven chamber 10. Gases and dusts produced in coke production are collected through a discharge passage 12 to a gas and dust collecting apparatus (not shown). When the coal is completely turned into coke, heating is stopped and the steel doors 1 are opened so that the coke may be shoved from the doors 1 on one side of the coke oven to the doors on the other side. In early coke ovens, an annular or ring-shaped steel packing 4 is interposed between the steel door 1 and a side wall of the coke oven in order to seal the coke oven. However, both the steel packing 4 and the side wall of the coke oven against which is pressed the steel packing 4 are not elastic so that complete sealing cannot be attained when the sealing surfaces are not smooth or distorted. As a result, the gases and dusts produced when the coke is manufactured escape out of the coke oven, thus resulting in an atmospheric pollution problem.

SUMMARY OF THE INVENTION

In view of the above problem, the primary object of the present invention is to completely prevent the leakage of gases and dusts from the coke oven chamber into the surrounding atmosphere by fitting an elastic member over the conventional steel packing so as to be elastically pressed against the side wall of the coke oven when the steel doors are closed.

BRIEF DESCRIPTION OF THE DRAWINGS

The present invention will become more apparent from the following description of several preferred embodiments thereof taken in conjunction with the accompanying drawings in which:

FIG. 1 is a transverse sectional view of a conventional coke oven;

FIG. 2 is a fragmentary side view of the coke oven shown in FIG. 1;

FIG. 3 is a side view of a first embodiment of a device for sealing doors of a coke oven assembled to an outer surface of a steel door;

DETAILED DESCRIPTION OF PREFERRED EMBODIMENTS

Figure 4:
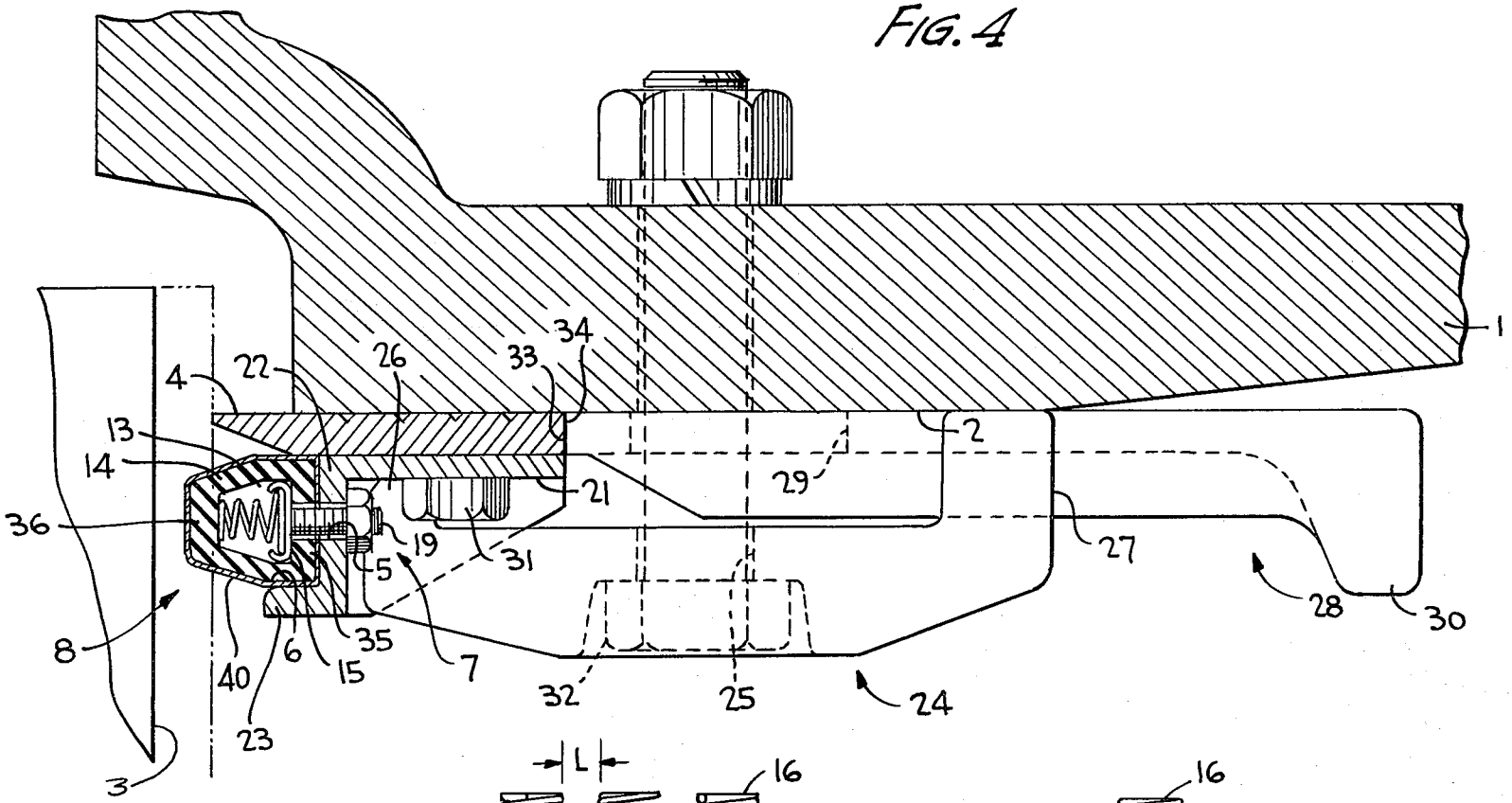
FIG. 4 is a sectional view taken along the line C—C of FIG. 3.

A first embodiment of the device for sealing doors of a coke oven is shown in FIGS. 3 and 4.

Figure 8:
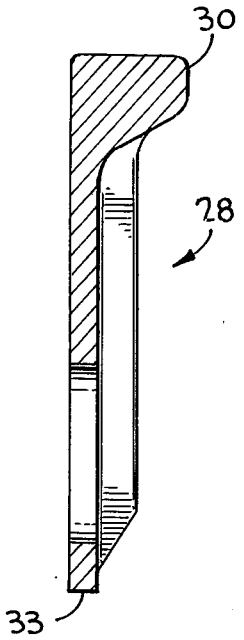
FIG. 8 is a sectional view taken along the line 8—8 of FIG. 7.
Figure 7:
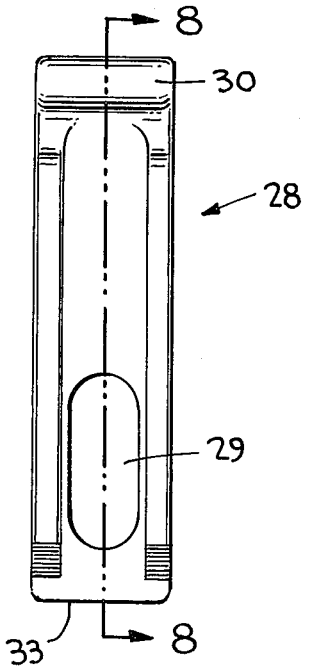
FIG. 7 is a front view of a wedge shown in FIG. 4.
Figure 10:
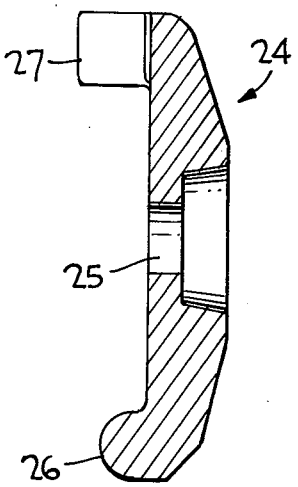
FIG. 10 is a sectional view taken along the line 10—10 of FIG. 9.
Figure 9:
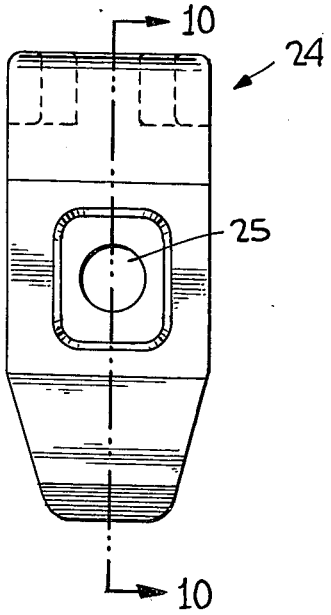
FIG. 9 is a front view of a holder shown in FIG. 4.

Referring to FIGS. 3 and 4, over the outer peripheral surface 2 of the steel door 1 is fitted the ring-shaped steel packing 4 whose side on the side of the side wall 3 of the coke oven (the inner side in FIG. 4) is in the form of a wedge. Over the steel packing 4 is fitted a packing gland or retainer 7 comprising a cylindrical section 21 fitted over and joined to the steel packing 4 with bolts 31, a flange section 22 extended radially outwardly from the lower side of the cylindrical section 21 and provided with a plurality of bolt holes 5, and a cylindrical section 23 extended inwardly toward the side wall 3 from the outer side of the flange section 22. The steel packing 4 and the packing retainer 7 are fitted over the steel door 1 and pressed against it by a plurality of holders 24 U-shaped in cross section joined to the outer surface 2 of the steel door 1 with bolts 32 in such a way that the packing 4 and the retainer 7 are movable over the outer surface 2 when impacts (produced by striking the flange portion 30 of a wedge 28 as described later by a hammer or the like) are exerted thereto. Each holder 24 is provided with a bolt hole 25 at the center thereof, a nose portion 26 whose lower end is extended inwardly towards the cylindrical section 21 of the steel packing 4, and a flange portion 27 extended inwardly towards the outer surface 2 of the steel door 1 (FIGS. 9 and 10). A wedge 28 having an L-shaped cross-sectional configuration interposed between the outer surface 2 of the steel door 1 and the holder 24 has an elongated bolt hole 29 and a flange portion 30 extended outwardly from the upper end (FIGS. 7 and 8). The bolt 32 which joins the holder 24 to the steel door 1 extends through the bolt hole 29 of the wedge 28. As the bolt 32 is tightened, the nose portion 26 forces the cylindrical section 21 of the packing retainer 7 against the outer surface 2 of the steel door 1 so that the steel packing 4 and the packing retainer 7 are pressed against the outer surface 2 of the steel door 1. The inner end 33 of the wedge 28 interposed between the steel door 1 and the holder 24 is made into contact with the upper end surface 34 of the steel packing 4. Into a ring-shaped groove 6 defined by the flange section 22, the cylindrical section 23 of the packing retainer 7 and the outer surface of the steel packing 4 and opened toward the side wall 3 is fitted a packing assembly 8 comprising an elastic member 14, preferably covered by a metallic film or a metallic foil 40 such as aluminum foil, which is made of a heat resisting rubber such fluoro rubber and has a longitudinal opening 13 formed in the rear section 35, a spring retainer 15 disposed within the elastic member 14 in contact with the inner side wall surface of the rear section 35, and a plurality of springs loaded between the spring retainer 15 and the inner side wall surface of the front section 36 of the elastic member 14. The spring retainer 15 is fastened to the packing retainer 7 with a plurality of bolts 19 joined to the spring retainer 15 by welding and extended through the opening 13.

The front section 36 of the elastic member 14 is extended more closely to the side wall 3 of the coke oven than the pointed end of the steel packing 4, and is pressed against the side wall 3 when the steel door 1 is closed.

Figure 6:
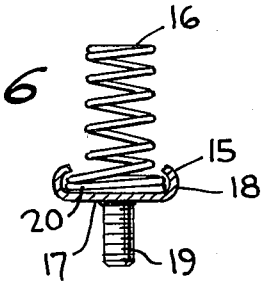
FIG. 6 is a sectional view of the spring retainer and springs shown in FIG. 5.
Figure 5:
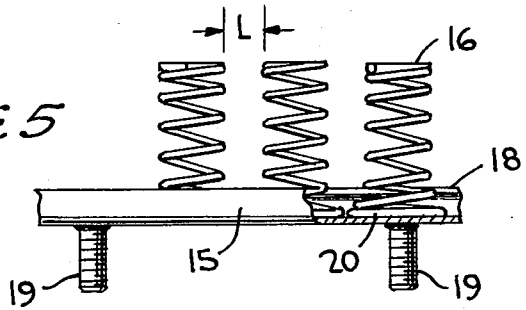
FIG. 5 is a side view, partly in section, of a spring retainer and springs shown in FIG. 4.

FIGS. 5 and 6 show the construction of the springs 16 and the spring retainer 15. The spring retainer 15 comprises a bottom section 17 made into contact with the inner wall of the rear section 35 and flange sections 18 bent inwardly from both sides of the bottom section 17 so as to retain the springs 16 therebetween. The plurality of bolts 19 are joined to the bottom section 17 by welding so that the spring retainer 15 is fixed to the packing retainer 7. The diameter of the coil 20 of the spring 16 which is held by the spring retainer 15 is made larger than that of the remaining coils so that the adjacent bottom coils contact each other as best shown in FIG. 5. The adjacent springs 16 are spaced apart from each other by a distance L (See FIG. 5).

Figure 11:
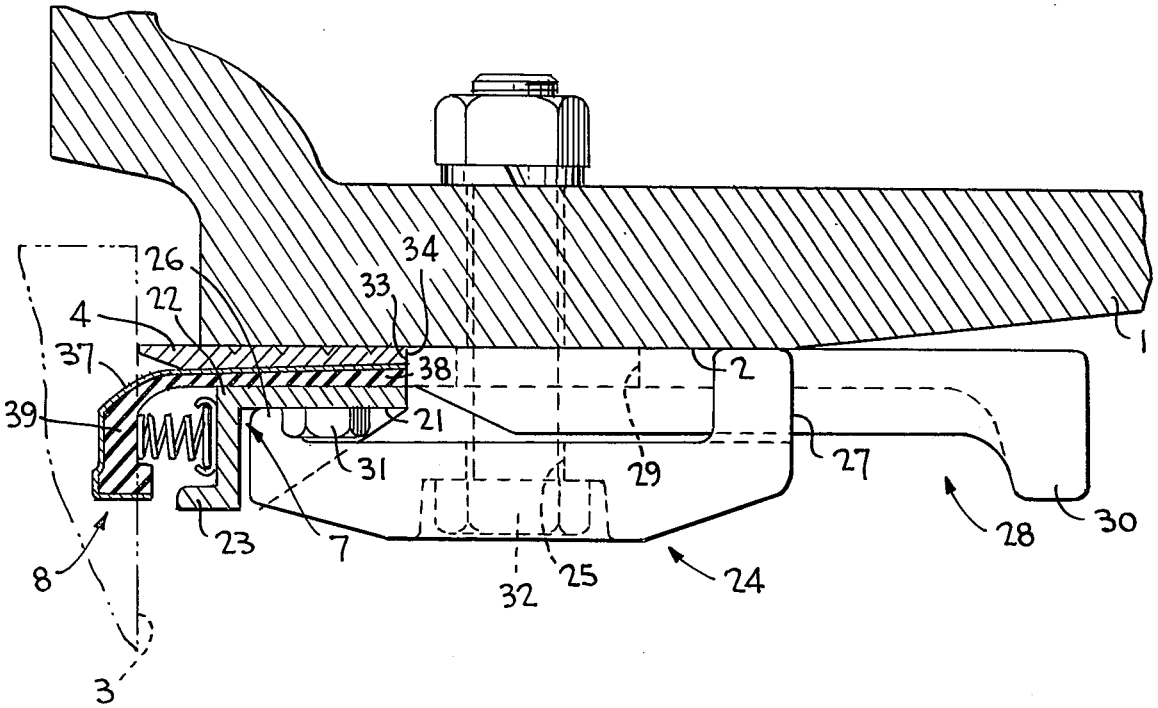
FIG. 11 is a sectional view, partly in section, of a second embodiment of a device for sealing doors of a coke oven assembled to an outer surface of a steel door.

In a variation shown in FIG. 11, a packing assembly 8 comprises a main section 38 lined with a metallic plate 37 such as copper and a lip portion 39. The main section 38 is interposed between the steel packing 4 and the cylindrical section 21 of the packing retainer 7 with the bolts 31.

Figure 12:
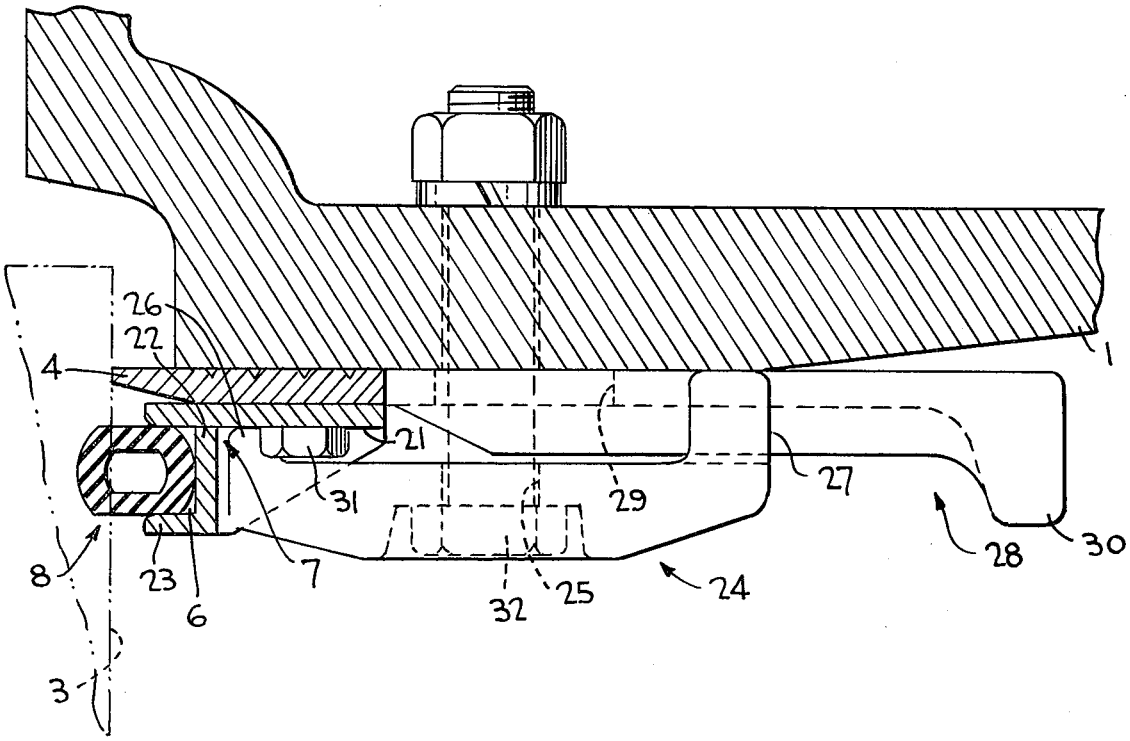
FIG. 12 is a sectional view, partly in section, of a third embodiment of a device for sealing doors of a coke oven assembled to an outer surface of a steel door.

Further, in the other variation shown in FIG. 12, the packing assembly 8 comprises a hollow O-ring. And the hollow O-ring is installed in the groove 6.

When the steel door 1 with the above construction is closed, the pointed end of the steel packing 4 is made into contact with the side wall 3 of the coke oven so that the leakage of the gases and dusts from the oven chamber to the surrounding atmosphere may be prevented to some extent. The gases and dusts which pass between the steel packing 4 and the side wall 3 are completely prevented from leaking into the surrounding atmosphere by the elastic packing assembly 8 which is elastically pressed against the side wall 3. Since the packing assembly 8 is disposed in side-by-side relation with the steel packing 4, the packing assembly 8 is prevented from being directly exposed to elevated temperatures.

When the steel packing 4 is heated so that it is deformed, leaving some gaps between the steel packing 4 and the side wall, the deformed portions of the steel packing 4 may be readily corrected by striking with a hammer or the like the flange portion 30 of the wedge 28 at the points where the gaps are formed without the steel packing 4 being removed from the steel door 1 (i.e. even when the operation of the coke oven is continued). Since the steel packing 4 may be corrected when it is heated to an operating temperature, the shape of the steel packing 4 may be precisely corrected. Thus, the stable sealing is ensured for a long time. And it is preferable that the packing assembly 8 is covered by the thin metallic lining 37, metallic film or foil 40 for preventing burning by the flame leaked out between the steel packing 4 and the side wall 3 of the coke oven.

According to the present invention, the gases and dusts are completely prevented from leaking from the coke oven chamber into the surrounding atmosphere so that the atmospheric pollution problem is overcomed.

I claim:

1. A device for sealing a steel door of a coke oven comprising: a ring-shaped steel packing fitted over an outer surface of the steel door so as to contact a side wall of the coke oven when the steel door is closed; a packing retainer fitted over and joined to the outer surface of the steel packing and provided with a ring-shaped groove opened toward the side wall of the coke oven; a ring-shaped packing assembly fitted into the groove so as to press elastically against the side wall when the steel door is closed, thereby sealing the steel door; the packing assembly extending closer to the side wall of the coke oven than the steel packing and comprising an elastic member having a front section and a rear section with a longitudinal opening, a spring retainer disposed within the elastic member in contact with the inner side wall surface of the rear section and a plurality of springs loaded between the spring retainer and the inner side wall of the front section of the elastic member; the spring retainer comprising a bottom section in contact with the inner wall of the rear section of the elastic member and flange sections bent inwardly from both sides of the bottom section so as to retain the springs therebetween; each of the springs having a bottom coil of larger diameter than the remaining coils and the bottom coil being held between the flange sections of the spring retainer so that the remaining coils of the springs are spaced apart from each other; and a holder attached to the steel door for movably holding the steel packing and the packing retainer against the steel door.

2. The device as claimed in claim 1 wherein the packing retainer comprises a cylindrical section fitted over and joined to the outer surface of the steel packing, a flange section extending radially outward from the side of the cylindrical section toward the side wall and provided with bolt holes and a cylindrical section extending inwardly toward the side wall from the outer side of the flange section.

3. The device as claimed in claim 1 wherein the packing assembly is joined to the packing retainer by a plurality of bolts which extend through the bolt holes of the flange section of the packing retainer and the opening in the rear section of the elastic member and are joined to the spring retainer.

4. The device as claimed in claim 1 wherein the holder comprises a nose portion extending inwardly toward the cylindrical section of the packing retainer fitted over the outer surface of the steel packing and a flange portion extending inwardly toward the outer surface of the steel door.

5. The device as claimed in claim 1, further comprising a metallic covering disposed over the packing assembly.

* * * * *